United States Patent [19]

Vecellio

[11] 4,225,747

[45] Sep. 30, 1980

[54] SUBMARINE ELECTRIC POWER CABLES CONTAINING NAPHTHALENE BASED LIQUIDS

[75] Inventor: Bernardino Vecellio, Milan, Italy

[73] Assignee: Industrie Pirelli Societa per Azioni, Milan, Italy

[21] Appl. No.: 924,857

[22] Filed: Jul. 17, 1978

[30] Foreign Application Priority Data

Jul. 29, 1977 [IT] Italy ..... 26298 A/77

[51] Int. Cl.[2] ..... H01B 3/22; H01B 7/34

[52] U.S. Cl. ..... 174/25 C; 174/17 LF; 252/63; 585/1

[58] Field of Search ..... 252/63; 174/25 C, 17 LF, 174/23 C

[56] References Cited

U.S. PATENT DOCUMENTS

| | | | |
|---|---|---|---|
| 1,667,214 | 4/1928 | Michel | 252/63 |
| 2,238,637 | 4/1941 | Gaylor | 252/63 |
| 2,436,110 | 2/1948 | Larsen | 174/25 C |
| 3,075,040 | 1/1963 | Lemmerich et al. | 252/63 X |
| 3,163,705 | 12/1964 | Feick et al. | 252/63 X |
| 3,549,537 | 12/1970 | Brewster et al. | 252/63 |
| 3,930,112 | 12/1975 | Pasini | 174/25 C |

FOREIGN PATENT DOCUMENTS

| | | | |
|---|---|---|---|
| 1338528 | 8/1963 | France | 252/63 |

*Primary Examiner*—Harris A. Pitlick

*Attorney, Agent, or Firm*—Brooks, Haidt, Haffner & Delahunty

[57] ABSTRACT

An insulating fluid for impregnating the solid insulation of an oil-filled electric power cable, particularly for a cable to be submerged in water, which comprises at least one lower aliphatic derivative of napthalene, preferably, 1 methylnapthalene or 1, 2, 3, 4-tetrahydronapthalene, or mixtures thereof or a mixture of one or more lower aliphatic derivatives of naphthalene with a conventional impregnating fluid. In the latter case, the derivative is present in a significant amount and preferably, is present in an amount sufficient to provide a specific gravity substantially equal to the specific gravity of water. Also, an electric power cable having its insulation impregnated with such insulating fluid.

7 Claims, 1 Drawing Figure

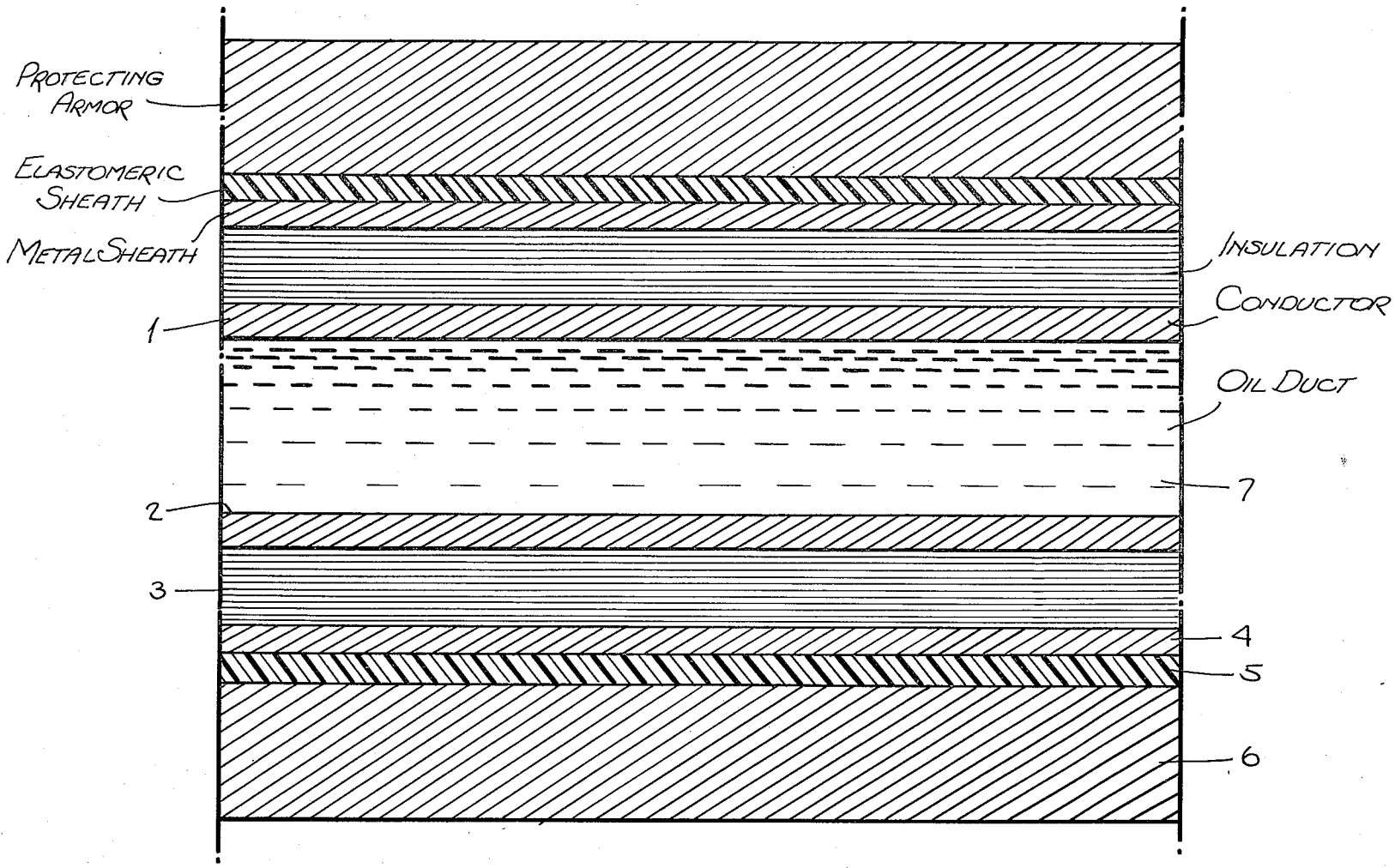
PROTECTING ARMOR
ELASTOMERIC SHEATH
METAL SHEATH
INSULATION
CONDUCTOR
1
OIL DUCT
2
7
3
4
5
6

SUBMARINE ELECTRIC POWER CABLES CONTAINING NAPHTHALENE BASED LIQUIDS

The present invention relates to a fluid for impregnating the insulation of electric, oil-filled power cables, and particularly for impregnating the insulation of cables intended to be used under water and to a cable containing such fluid.

As used herein, "oil-filled cables" means electric power cables having an insulation composed of a paper and dielectric fluid and which are of the self-contained type from which the dielectric liquid can flow in or out, according to whether expansions or contractions occur as a consequence of the thermal conditions of the cable, the cable insulation being continuously maintained totally impregnated.

Conventional impregnating fluids are well known in the art and include hydrocarbon oils, both of an aliphatic and aromatic base, and of natural or synthetic origin, e.g. alkylbenzene and other alkyl-aryl derivatives, polybutenes, polyisobutylenes, and petroleum derivatives, e.g. mineral oil. Some of such fluids are described in U.S. Pat. No. 3,930,112.

It is known to those skilled in the art that the fluid for impregnating the paper insulation of the electric, oil-filled power cables must possess special physical and electrical characteristics. In the first place, said fluid has to be liquid and must have a viscosity that is sufficiently low, (less than 15 centistokes at 20° C.) to be able to follow, with cycles of expansion and contraction, the thermal variations of the cable, and hence, to maintain the insulation of the cable itself totally impregnated. Such low viscosity besides, must not confer on the fluid itself an excessively high volatility.

In the second place, said fluid must possess high insulating properties and, in particular, it must also have a low dielectric loss (tan $\delta$) and preferably, be equal to or less than 0.001.

Said fluid, which generally is an oil of an organic nature, must have, in addition, very little or no tendency to have solid paraffinic products separate therefrom at the lowest temperatures of the cable encountered in use.

Fluids having these characteristics have been discovered previously, and such fluids are hydrocarbons having a molecular weight between 200 and 400 and obtained by the alkylation of an aromatic ring. The usage of such hydrocarbons, constituted by an aromatic ring, having an aliphatic chain, linear or branched, containing from 9 to 12 atoms of carbon, is described in the Italian Pat. No. 594475 and in its complement No. 809256, both being patents of the assignee of this application. The densities of these compounds at 20° C. are about 0.87 grams/cm$^3$.

The use of the fluids described in said Italian patents as fluids for impregnating the insulation of electric power cables has been, up to the time of the present invention, indicated to be the best for land or submarine cables for shallow depths. Nevertheless, certain drawbacks still exist when the cable is to be immersed in water at great depths, since the density of the said fluids is less than the average density of the water (salt-water or fresh-water). Sea water can have a specific gravity between 1.02 and 1.03 g/cm$^3$ at 20° C.

As is known, the difference between the hydrostatic pressures that act outside and inside the submerged cable is proportional to the difference between the density of the ambient water and the density of the impregnating fluid. When this latter difference assumes high values, there arises the danger of a collapse of the metallic sheath protecting the cable.

For these reasons, it is necessary in such cases, to increase the density of the impregnating fluid up to a value equal to or approximately equal to that of the density of the ambient water. This is efficaciously obtained by adding to the impregnating fluid, quantities of halogenated hydro-carbons, calculated as required, as described in the Italian Pat. No. 1,011,139 of the assignee of this application.

In said Italian Pat. No. 1,011,139 and said U.S. Pat. No. 3,930,112 there is particularly recommended the use of hexachlorobutadiene, which has a density of 1.68 g/cm$^3$ at 20° C. The usage of halogenated hydrocarbons (and chlorinated, in particular) as additives to the impregnating fluid, are suited to the purpose of regulating the density as desired, but it leaves open a problem linked to the aging of the cable.

As a matter of fact, the compounds described in said patent have the tendency, more or less accentuated, of becoming decomposed through the action of heat, for which reason such compounds give rise to a certain chemical attack by the halogen on the copper of the conductors, with the resulting formation of conductive salts and a consequent serious danger to the electrical insulation. In practice, this phenomenon occurs slowly even in favorable conditions so that the concentrations of the halides produced reach values that become actually dangerous only after the cable has been in use for a very long time. Hence, the use of halogenated hydrocarbons can be the cause of really dangerous situations only when the conditions of use of the cable are particularly severe, when the concentrations of the halogenated hydrocarbon itself are rather high and, finally, when the cable has remained in use for a good many years.

However, the aim of the present invention is to overcome this drawback, by providing an impregnating fluid possessing a permanent chemical stability and which besides has excellent dielectric characteristics. Surprisingly, applicant has found that such an impregnating fluid can be obtained by adopting as an impregnating fluid, per se or as an additive to the impregnating fluids commonly used in the art, certain lower aliphatic derivatives of naphthalene. Said derivatives can be used alone or mixed one with the other.

When the lower aliphatic derivative of naphthalene is added to other conventional fluids, a significant amount thereof is always included and preferably, in the case of underwater cables the amount thereof is sufficient to provide an impregnating fluid having a specific gravity substantially equal to the specific gravity of water, e.g. 1.02–1.03 g/cm$^3$ at 20° C. if the cable is to be immersed in sea water. Preferably, also, such lower aliphatic derivative is substituted, as much as possible and consistent with the desired specific gravity, for halogenated hydrocarbons in known fluids which contain halogenated hydrocarbons.

The compounds according to the present invention, have, in fact, such physical and electrical characteristics, as to satisfy the requirements of impregnating fluids for electrical power cables. Besides this, the tendency of solid products to separate from said compounds at lower working temperatures is practically nil.

Whenever the compounds, according to the present invention are used as additives to the conventional impregnating fluids, they present, with respect to other hydrocarbon compounds, the further advantage of having the potential of chemically fixing the gases that develop from the insulation paper and from the impregnating fluid used, as a result of the heating and the aging of the cable. As is known, said gases tend to ionize, owing to the high electric field present around the conductor. Such ionization could also be the cause of disastrous electrical discharges inside the cable itself.

Accordingly, the principal object of the present invention is a fluid for impregnating the paper insulation of electrical oil-filled power cables, and particularly cables destined to be submerged under water, said fluid having a viscosity of less than 15 centistokes at 20° C. with the loss factor in the dielectric (tan δ) being equal to or less than 0.001, characterized by the fact that the fluid comprises at least one lower aliphatic derivative of naphthalene.

Other objects and advantages of the invention will be apparent from the following detailed description of preferred embodiments thereof, which description should be considered in connection with the accompanying drawing, the single figure of which illustrates, in longitudinal cross-section, a portion of a known type of submarine cable. Although one type of cable is illustrated, it will be understood that the invention may be used with cables of a construction different from the cable illustrated.

In the figure of the drawing, a hollow conductor 1 defines an oil duct 2. Around the conductor 1 there is insulation 3 formed by layers of paper which are impregnated with oil under pressure. The insulation 3 is surrounded by a metal sheath 4 which in turn is surrounded by an elastomeric sheath 5. The cable is protected by a layer or layers 6 of a known type, such as frettage, armor, etc. The oil duct 2 is filled with the oil mixture 7 of the invention and this mixture is also supplied to the insulation 3 from the duct 2 in a known manner.

The following Table shows some of the physical properties of a series of aliphatic derivatives of naphthalene that are of particular interest for the purposes of the present invention. The details have been taken from the well-known "Handbuch Der Organischen Chemie" (Vierte Auflage) by Beilstein.

PHYSICAL PROPERTIES OF SOME LOWER ALIPHATIC DERIVATIVES OF NAPHTHALENE

| DERIVATIVES (Type and positions of the aliphatic substituent) | MELTING POINT (°C.) | DENSITY AT 20° C. WITH RESPECT TO $H_2O$ at 4° C. ($g/cm^3$) | VISCOSITY-AT 20° C. (centistokes) |
|---|---|---|---|
| 1-methyl | −30 | 1.020 | 3.5 |
| 1-ethyl | −15 | 1.008 | 4.1 |
| 2-ethyl | −7 | 0.993 | 2.9 |
| 1-propyl | −12 | 0.992 | 4.9 |
| 1-butyl | −20 | 0.975 | 6.5 |
| 2-butyl | −5 | 0.970 | 4.75 |
| 2-tert-butyl | −4 | 0.970 | — |
| 1-pentyl | −22 | 0.966 | — |
| 2-pentyl | −4 | 0.956 | — |
| 1,3-dimethyl | −4 | 1.006 | — |
| 1,6-dimethyl | −14 | 1.003 | — |
| 1,2,3,4-tetrahydro | −36 | 0.970 | 2.2 |

From amongst the compounds given in the Table, the Applicant has found the 1-methylnaphthalene to be particularly preferred in certain embodiments of this invention.

1-Methylnaphthalene possesses, besides all the physical characteristics required of a fluid for impregnating the insulation of oil-filled electrical power cables, a particularly low loss factor in the dielectric (tan δ), i.e. lower than 0.001. In cases where the actual density of the 1-methylnaphthalene compound (e.g., 1.020 $g/cm^3$ at 20° C. with respect to water at 4° C.) is not what is desired, it is possible to provide a suitable mixture with homologous derivatives up to values that are as close as possible to the values sought.

Naturally, it is possible, while maintaining all the above cited advantages, to utilize the said mixture as an additive for the conventional impregnating fluids that are normally used in the art.

In a further form of realization of the impregnating fluid, according to the present invention, the Applicant has discovered that amongst the aliphatic derivatives of naphthalene, set forth in the Table, 1, 2, 3, 4-tetrahydronaphthalene is also advantageous.

Another object of the present invention is an oil-filled electric power cable in which the fluid impregnant for the insulating material placed around the metallic conductors is a lower aliphatic derivative of naphthalene, or a mixture thereof, or a conventional fluid having added thereto one or more of the said derivatives.

It will be apparent to those skilled in the art that various modifications may be made without departing from the principles of the invention exemplified by the preferred embodiments of the invention which have been illustrated and described.

The embodiments of the invention in which an exclusive property or privilege is claimed are defined as follows:

1. A liquid oil-filled, submarine, electric power cable comprising a conductor surrounded by insulation and at least one longitudinal duct capable of circulating said liquid oil, said duct being substantially filled with and said insulation being impregnated with a liquid oil having a viscosity less than 15 centistokes at 20° C. and a low dielectric factor not greater than 0.001, said liquid oil comprising a naphthalene compound selected from the group consisting of 1-methylnaphthalene, 1-ethylnaphthalene, 2-ethylnapthalene, 1-propylnaphthalene, 1-butylnaphthalene, 2-butylnaphthalene, 2-tert-butylnaphthalene, 1–3-dimethylnaphthalene, 1–6-dimethylnaphthalene, 1,2,3,4-tetrahydronaphthalene and mixtures thereof.

2. A cable as set forth in claim 1 wherein said liquid oil further comprises a liquid selected from the group consisting of alkyl-aryl compounds, polybutenes, polyisobutylenes, petroleum derivatives and mixtures thereof mixed with said oil.

3. A cable as set forth in claim 2 wherein the proportions of the liquids are such that said mixture has a specific gravity substantially equal to the specific gravity of water.

4. A cable as set forth in claim 1 wherein said liquid consists of a mixture of 1,2,3,4-tetrahydronaphthalene and at least one of the other of said naphthalene compounds.

5. A cable as set forth in claim 1 wherein said naphthalene compound is 1-methylnaphthalene.

6. A cable as set forth in claim 1 wherein said naphthalene compound is 1,2,3,4-tetrahydronaphthalene.

7. A cable a set forth in claim 1 wherein said liquid oil has a specific gravity substantially equal to the specific gravity of the water in which the cable is immersed.

* * * * *